US007244183B1

(12) United States Patent
England

(10) Patent No.: US 7,244,183 B1
(45) Date of Patent: Jul. 17, 2007

(54) GAMING SYSTEM EMPLOYING BOTH ACTION FIGURE AND VIDEO GAME PLAY

(76) Inventor: Anthony England, 14120 Wabash Ave., Riverdale, IL (US) 60827

( * ) Notice: Subject to any disclaimer, the term of this patent is extended or adjusted under 35 U.S.C. 154(b) by 852 days.

(21) Appl. No.: 10/665,613

(22) Filed: Sep. 19, 2003

(51) Int. Cl.
*A63F 13/00* (2006.01)
*A63H 30/00* (2006.01)
*A63F 30/00* (2006.01)

(52) U.S. Cl. ..... 463/48; 446/175; 463/47; 463/49

(58) Field of Classification Search ..... 463/43, 463/47–50, 53; 446/175
See application file for complete search history.

(56) References Cited

U.S. PATENT DOCUMENTS 4,815,733 A * 3/1989 Yokoi ..... 463/31
5,766,077 A * 6/1998 Hongo ..... 463/30
6,254,486 B1 * 7/2001 Mathieu et al. ..... 463/52
6,468,162 B1 * 10/2002 Nakamura ..... 463/43
6,592,461 B1 * 7/2003 Raviv et al. ..... 463/37
6,773,325 B1 * 8/2004 Mawle et al. ..... 446/175
6,786,826 B2 * 9/2004 Himoto et al. ..... 463/43
7,081,033 B1 * 7/2006 Mawle et al. ..... 446/175

* cited by examiner

*Primary Examiner*—Mark Sager
*Assistant Examiner*—Robert Mosser
(74) *Attorney, Agent, or Firm*—Goldstein Law Offices PC.

(57) ABSTRACT

A gaming system that employs a video game system and action figures to allow both video game play and action figure play. A video game score, obtained by a player through video game play, may be transferred to the action figure associated with that player to become the action figure score of that action figure. The action figures have a gun that generates a light beam and a target detector for receiving light beams from other action figures. The action figure will register a hit, and break apart, if its target detector receives a light beam from another action figure that has a higher action figure score.

10 Claims, 6 Drawing Sheets

GAMING SYSTEM EMPLOYING BOTH ACTION FIGURE AND VIDEO GAME PLAY

BACKGROUND OF THE INVENTION

The invention relates to a gaming system. More particularly the invention relates to a system that allow scored play with action figures whereas the score achieved by a player during video game play alters the competitive advantage of the player during action figure play.

During the past few decades, video game imagery has evolved from mere blips on a black and white video screen to photorealistic images. Video game controllers have evolved from a simple, four-way-switch joystick to precision pressure-sensitive controllers and virtual reality sensors that register movements of the player's body. Processing power inherent in gaming systems allow complex game play with numerous three dimensional objects following complex trajectories and allow multi-level game play between players in different parts of the world. One fact remains, however, that video game play still remains an interaction on the video game screen.

Real world toys, have had a similar, although separate evolution. The action figures of decades past, that had spring-loaded releasing parts, or talked when a string was pulled and released, have been overshadowed by microchip controlled toys of today.

With all of the advances in both video game and action figure toys, however, little development has taken place to join video game and action figure play.

U.S. Pat. No. 6,283,862 to Richter ("Richter") discloses a computer controlled game system. Richter projects an image into a projection zone, and registers movement in a portion of the projection zone using an electromagnetic beam. Richter, however, does not employ action figure play and only allows game play to take place in the vicinity of the projection zone.

U.S. Pat. No. 6,322,365 to Shechter et al. ("Shechter") discloses a network-linked laser target firearm training system. Schecter is an involved system that allows target shooters to competitively linked via a computer network between distinct geographic locations. Schecter, however, is strictly intended for target shooting at a fixed target that is hardwired to one of the networked general purpose computers.

U.S. Pat. No. 5,589,945 to Abecassis ("Abecassis") discloses a computer-themed playing system. In particular, Abecassis discloses a video playback system that allows random access to a variety of video segments, according to choices by the user. Abecassis suggests a possible use for interactive video game play, whereas content may be selected "responsive to the logic of the interactive video game software". Abecassis, however, neither describes how such interactive video game play is to be carried out, nor suggests any incorporation of such technology with action figure play.

U.S. Pat. Nos. 6,171,190 and 6,323,838 to Thanasack et al. ("Thanasack") disclose a photosensitive input peripheral device in a personal computer-based video gaming platform. In particular, Thanasack discloses a system that allows a video monitor to be used as a target for a light sensitive device.

U.S. Pat. No. 6,261,180 to Lebensfeld et al. ("Lebensfeld") discloses a computer programmable interactive toy for a shooting game. In particular, Lebensfeld et al. discloses a portable interactive toy that includes a gun, target, and data module. The toy interacts with the base unit to communicate shots fired and hits of various players. In essence, Lebensfeld describes a variation of a "laser tag" game, but does not disclose a system that allows interactive play between action figures controlled by the players.

U.S. Pat. No. 5,375,847 to Fromm et al. ("Fromm") discloses a toy assembly. In particular, Fromm et al. discloses a toy figurine that is structured with a toppling mechanism for causing the figurine to topple over when a beam of light associated with a toy gun is detected thereby. Fromm, however, does not disclose any mechanism for even keeping score, no less any features that facilitate integration with a more advanced gaming system.

In a similar regard as Fromm, U.S. Pat. No. 6,071,166 to Lebensfeld et al. discloses a pair of light shooting and detecting toy figures. In particular, Lebensfeld discloses a pair of figures that are held by the user and which are each capable of both emitting a beam of light and sensing a beam of light incident thereupon from the other figure. The figures of Lebensfeld, however, are intended to be hand-held—severely limiting the manner of play.

U.S. Pat. No. 5,738,584 to Ikematsu et al. ("Ikematsu") and U.S. Pat. No. 5,785,592 to Jacobsen both disclose interactive target game systems that employ light emitters and detectors to allow "shooting gallery" type game play. U.S. Pat. No. 5,904,621 to Small et al. ("Small") discloses an electronic game with infrared emitter and sensor that is essentially a variation of popular laser tag systems.

While these units may be suitable for the particular purpose employed, or for general use, they would not be as suitable for the purposes of the present invention as disclosed hereafter.

SUMMARY OF THE INVENTION

It is an object of the invention to provide a gaming system that employs action figures that interact in simulated battle scenarios. Accordingly, the action figures have simulated guns that emit light, have detectors that sense the presence of light incident from another of the action figures upon a target region, and have means for scoring "hits" thus detected by each of the figures.

It is another object of the invention to provide a gaming system that allows mobility of the gaming figures for realistic interaction between the figures. Accordingly, the figures are selectively seated upon a vehicle; and both mobility of the vehicle and the firing of the guns are controllable by the player with a hand-held remote control. The figures may also be removed from the vehicle and used in a standing position.

It is yet another object of the invention to provide a gaming system that provides visual feedback when one of the figures is hit. Accordingly, the figures are configured to break apart when they are hit.

It is yet a further object of the invention to provide a gaming system that integrates game play between video game play and subsequent action figure play. Accordingly, the score a player achieves during video game play is transferred to the action figures, and helps determine the vulnerability of the action figures to hits from the other figures and the ability of the action figure to hit and destroy other players. Accordingly, when light from another figure's gun is detected by one of the figures, it will only score a hit and destroy the attacked figure if the attacking figure has a higher score than the attacked figure.

It is a further object of the invention that the strength of the action figures are readily visible thereon at the option of the player. Accordingly, each figure has a display that can be used to display the strength achieved/accumulated by the player. The player may selectively enable or disable such display using the remote control.

It is a still further object of the invention to provide a mode that allows the action figures to compete irrespective of their strength/score. Accordingly the action figures can selectively and voluntarily enter a quick draw mode. Once in the quick draw mode, the first action figure to strike the target of the other action figure will destroy the attacked action figure, even if the attacked action figure has a higher score.

The invention is a gaming system that employs a video game system and action figures to allow both video game play and action figure play. A video game score, obtained by a player through video game play, may be transferred to the action figure associated with that player to become the action figure score of that action figure. The action figures have a gun that generates a light beam and a target detector for receiving light beams from other action figures. The action figure will register a hit, and break apart, if its target detector receives a light beam from another action figure that has a higher action figure score.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Within the following description, a gaming system is described that integrates video game play, using a video game system, with action figure play. According to the present invention, skillful play during video game play helps a player achieve a competitive advantage during action figure play.

Figure 1:
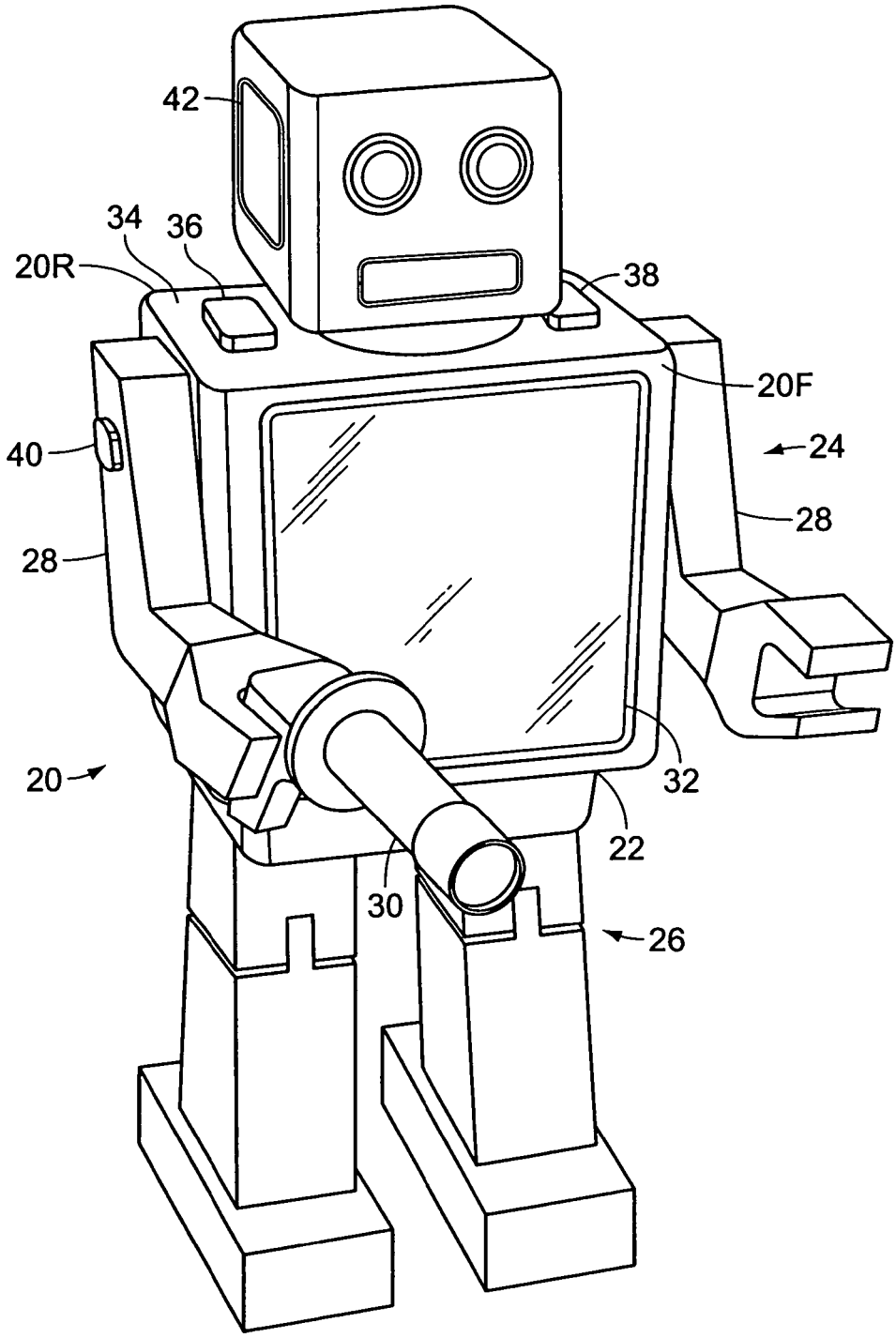
FIG. 1 is a front elevational view of an action figure according to the present invention, in the standing position.

FIG. 1 illustrates an action figure 20 that forms a part of the gaming system according to the present invention. In particular, during action figure play, one of the action figures is associated with each player. Each action figure may take on a variety of shapes but has a generally humanoid shape and appearance, having a waist 22 that separates an upper portion 24 and lower portion 26. The action figure 20 has a pair of arms 28 and a light producing gun 30 attached to one of the arms 28 that selectively produces a highly directional light beam. The action figure has a front 20F and a rear 20R. The action figure has at least one detector target 32, preferably located on the front 20F, on the upper portion 24. The detector target 32 is capable of detecting the light beam from the light producing gun 30 of other action figures. It should be noted that within the scope of the present invention, the light beam may be visible light, and may also be infrared, ultraviolet, or other forms of electromagnetic radiation that has the directional propagating and detection properties suitable for the goals of the present invention.

The action figure 20 has a shoulder surface 34 having a fire button 36 and a quick draw button 38. A reset button 40 is also provided on one of the arms 28. Clearly, the positioning of buttons 36, 38, 40 may be altered to facilitate ease of use and as the shape of the action figure itself is varied, and such buttons may be labeled with indicia as necessary to indicate their purpose.

Figure 2:
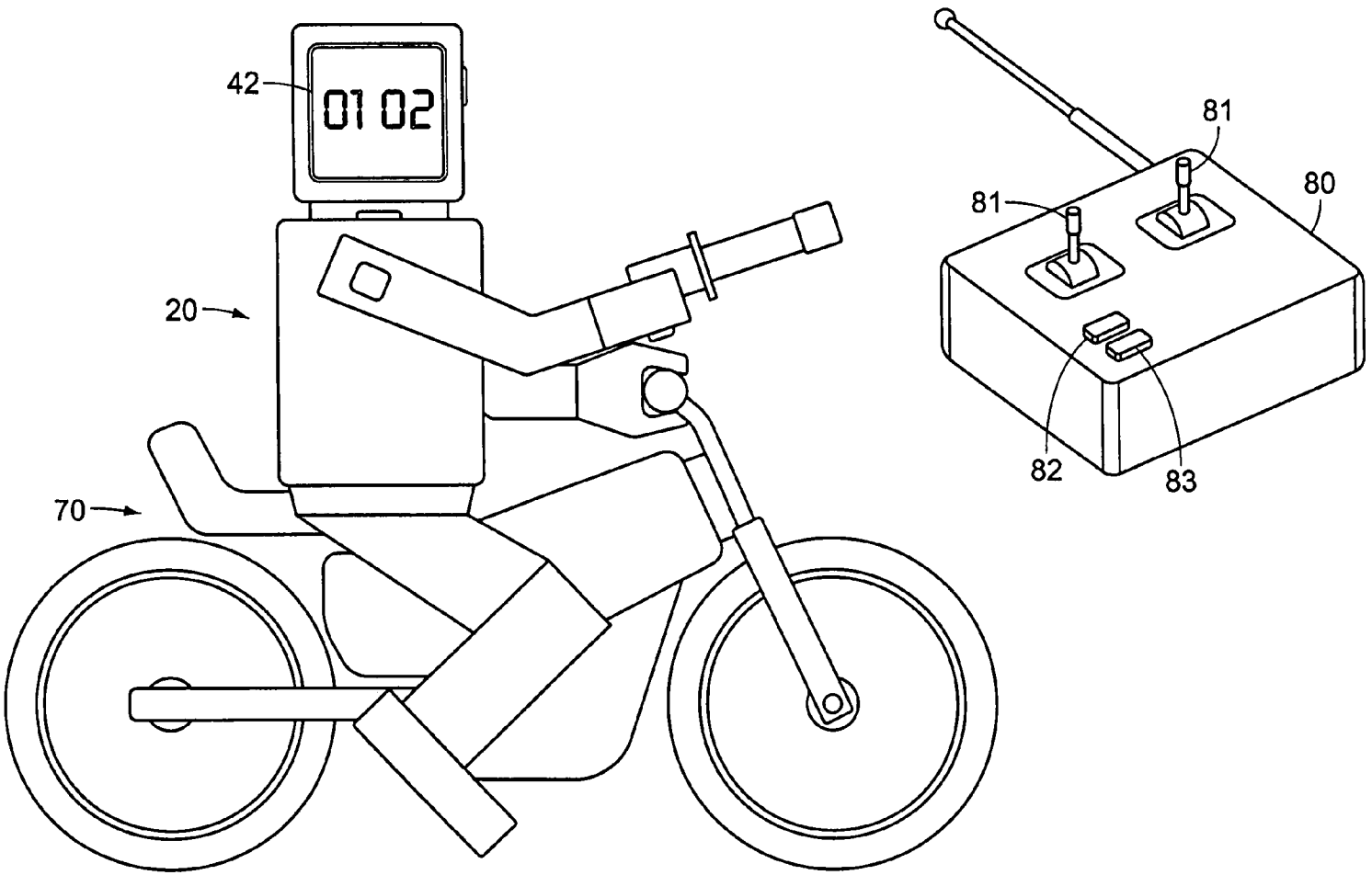
FIG. 2 is a side elevational view of the action figure seated on a vehicle, wherein the action figure and vehicle are controlled with a hand-held remote control.

A score display 42 is provided on the action figure 20. The score display 42 may be used to selectively display a score of the action figure 20 as indicated in FIG. 2, under the control of the player. Accordingly, if the player does not wish to display the score of the action finger associated therewith, the player can opt to blank the score display 42, as indicated in FIG. 1.

Figure 6:
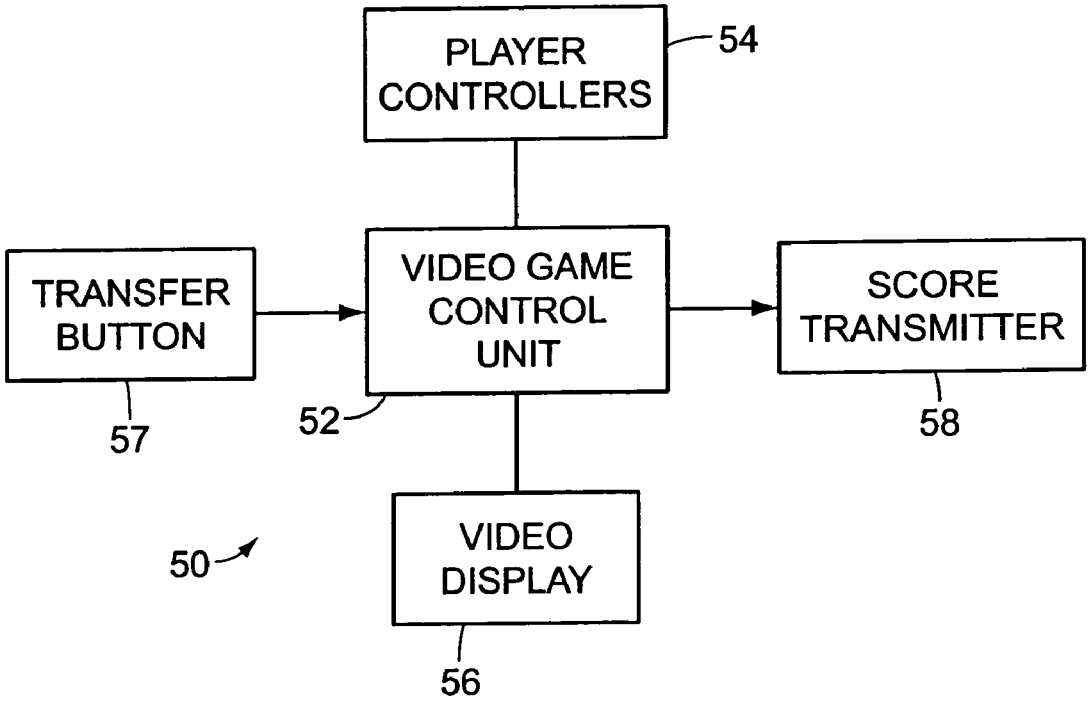
FIG. 6 is a block diagram, illustrating the video game portion of the present invention.

According to the present invention, the gaming system employs the video game system 50, illustrated in FIG. 6. In many respects, the video game system 50 is conventional, having a video game control unit 52 which may be microcontroller or microprocessor based; having at least one player controller 54; and having a video display 56. In a conventional manner, the player plays a video game, by viewing the video display 56 and manipulating the player controller 54. Also in a conventional manner, the player achieves a video game score by meeting the objectives of the video game. The video game score achieved will be greater as the skill level of the player increase.

Now, in accordance with the present invention, the video game score may be transferred to one of the action figures 20 by the player, such that the action figure score becomes the video game score. To facilitate such transfer, the video game system has a score transmitter 57 that is configured to transfer the video game score to one of the action figures. A variety of technologies and schemes may be used to achieve telemetry between the video game control unit 52 and the action figure 20. However, a simplistic scheme involves an encoded light beam of the type detectable by the target detector 32 on the action figure. Such requires only minimal additional hardware by way of a light emitter associated with the video game system 50. Accordingly, it is preferred that the score transmitter 57 is a light emitter that produces an encoded signal when prompted by a player by pressing a transfer button 58. Thus, the player holds the target detector 32 of the action figure 20 associated with that player in the immediate vicinity of the score transmitter 57 and presses the transfer button 58. The video game system produces the encoded signal, which includes the video game score. The action figure 20 decodes the encoded signal and makes the score received thereby the action figure score.

Figure 7:
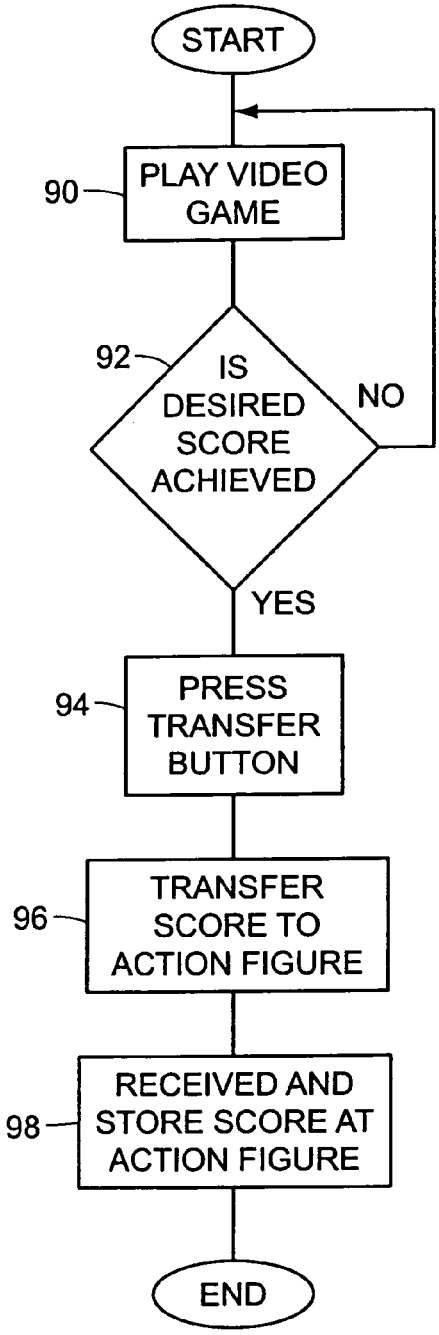
FIG. 7 is a flow diagram, illustrating steps by which video game and action figure play is integrated.

According to the goals of the present invention, the action figure score alters its effectiveness and interactions with other action figure and other gaming system objects. In particular, each action figure has its own action figure score, and other gaming objects (such as fixed target objects, monsters having a detecting target, etc.) have their own value. Thus, if the action figure 20 can successfully attack a gaming object with a value less than the action figure's score, or can successfully attack another action figure with a lower score. It should be apparent then, by obtaining its score from the video game system, the action figure's competitive ability during action figure play is directly affected by the video game score. Therefore, by skillfully achieving a higher video game score, a player is assured success during action figure play against other players possessing action figures having a lower action figure score. Referring then to FIG. 7, the player plays the video game 90, and continues to do so until the player achieves a video game score desired by said player 92—at which time the player holds the action figure associated with that player in the vicinity of the video game system and presses the transfer button 94. The video game score is transferred to the action figure 96 and is received and stored by the action figure 98.

Figure 8:
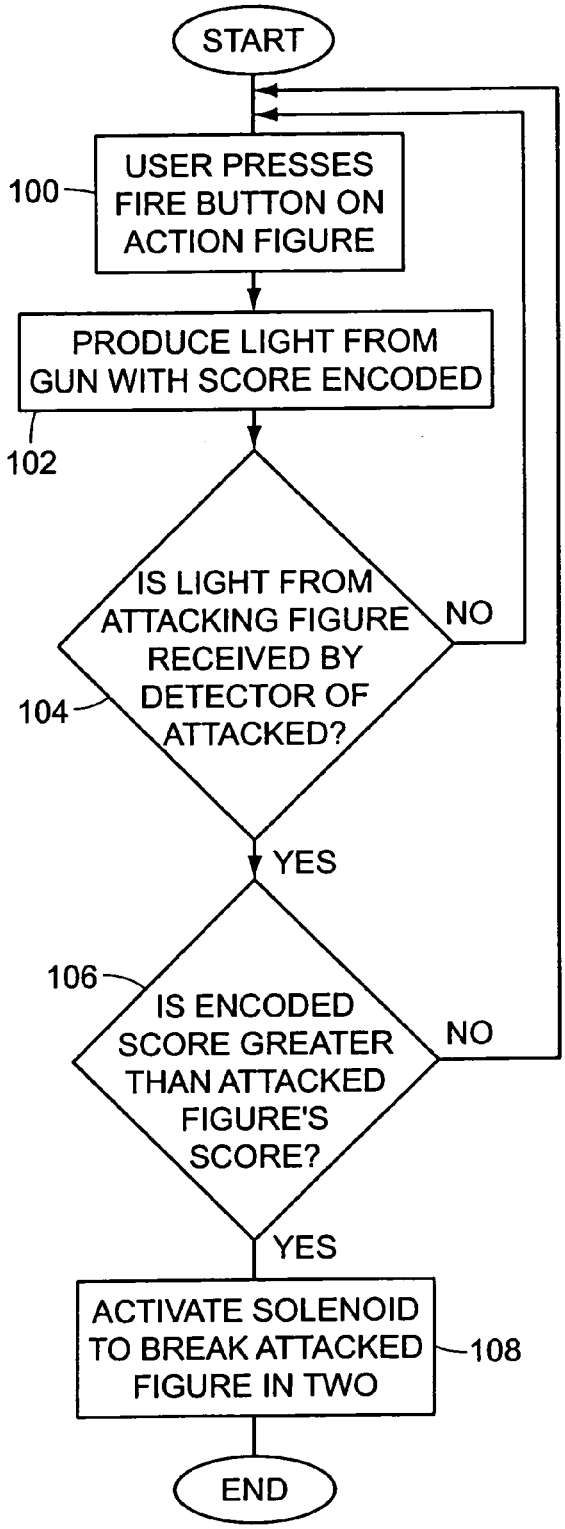
FIG. 8 is a flow diagram, illustrating a battle sequence of action figure play.

To illustrate the manner in which the action figure score alters its effectiveness during action figure play, reference may be made to FIG. 8. As illustrated, during action figure play, the player typically will repeatedly press the fire button on the action figure 100. The gun produces a light beam with the action figure score encoded therein 102. If the light beam is not detected by the target detector of an attacked action figure, the player will continue to press the fire button 100. If the light beam is detected by the target detector of an attacked action figure 104, it is determined whether the encoded action figure score thus detected is greater than the action figure's score 106. Such repeated firing 100, production of light beams 102, detection of light beams 104, and determination of the score associated with the incoming light beams 106 will continue until the incoming light beam is associated with an action figure having a score greater than the attacked figure's action figure score, at which point the attacked figure is deemed to have been "hit" or "destroyed". To add to the dramatic effect of the same, the action figure breaks apart. To accomplish the same in a non-destructive manner, a solenoid is activated to break the attacked figure into two pieces 108. At this point, of course, the action figure can be reassembled, and reset using the reset button 40.

Figure 4:
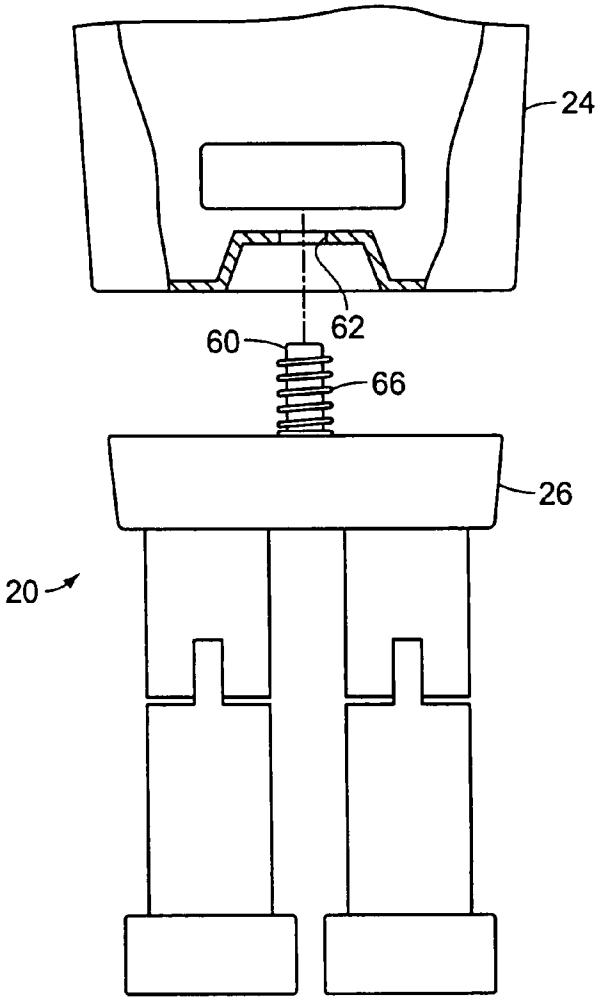
FIG. 4 is a cross sectional view, similar to FIG. 3, except wherein the attachment mechanism has released, causing the upper portion of the action figure to repel from the lower portion of the action figure.
Figure 3:
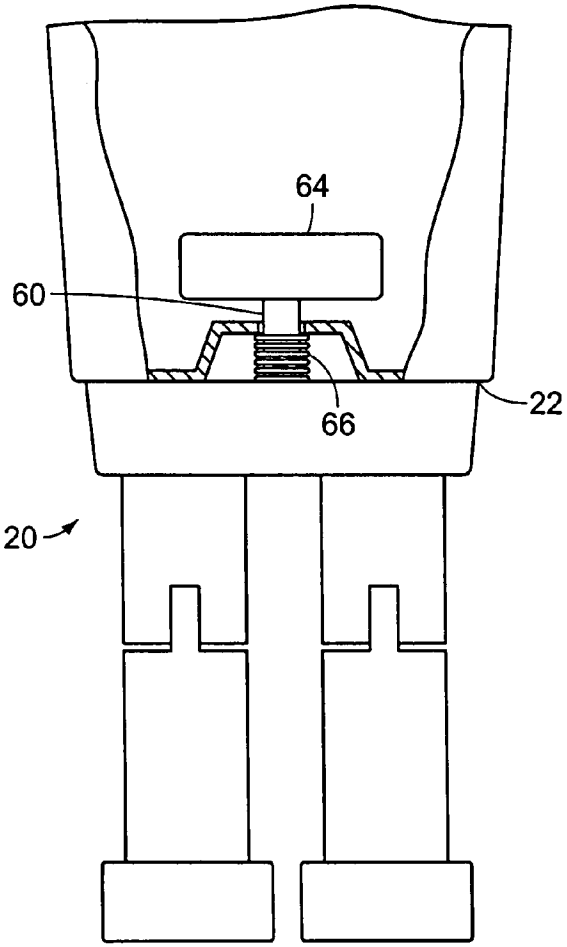
FIG. 3 is a cross sectional view, illustrating an attachment mechanism that selectively attaches upper and lower portions of the action figure, that selectively detaches when the action figure is "hit" by incoming fire.

FIGS. 3 and 4 illustrate a non-destructive mechanism for facilitating the action figure 20 breaking apart when hit. In particular, The upper and lower portions 24, 26 of the action figure 20 are distinct components that are selectively attached together using a pin 60 that extends vertically downward from the upper portion. The pin extends upwardly into an upper portion opening 62 and then finally into a solenoid catch 64 within the upper portion 24 that selectively holds and releases the pin 60. When the upper and lower portions 24, 26 are assembled, the pin 60 is held securely by the solenoid catch 64. The upper portion 24 is preferably allowed to rotate on the pin 60, to allow movement of the action figure 20 at its waist 22. When the action figure 20 is to break apart, the solenoid catch 64 is signaled to release the pin 60 to allow the upper and lower portions 24, 26 to separate. To make their separation more dramatic, however, a spring 66 is disposed around the pin 60. The spring 66 is compressed between the upper and lower portions 24, 26 when they are mated together. When the pin 60 is released by the solenoid catch 64, the spring 66 is allowed to expand, propelling the upper portion 24 upwardly, and creating a dramatic yet non-destructive separation of the upper and lower portions 24, 26.

Figure 5:
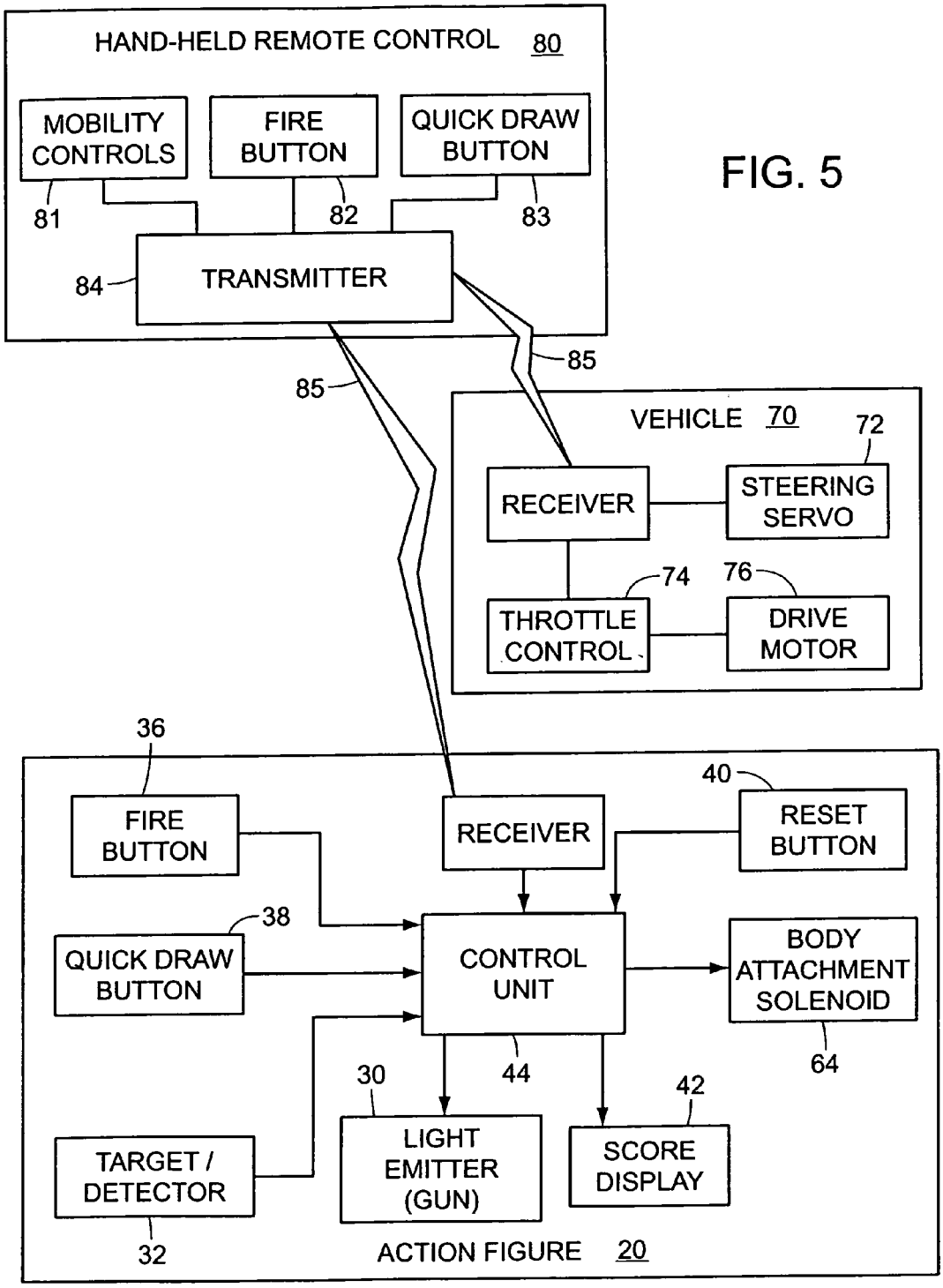
FIG. 5 is a block diagram, illustrating interconnection between the hand-held remote control, and the action figure and vehicle.

Referring to FIG. 2, to enhance action figure play by providing the action figure freedom of movement, the action figure 20 is selectively seated upon a vehicle 70; and the vehicle 70 and action figure 20 selectively controllable with a hand-held remote control 80. The vehicle may be in various configurations. Preferably, however a two-wheeled motorcycle or three-wheeled "trike" is preferred. Referring to both FIG. 2 and FIG. 5, the hand-held remote control 80 has mobility controls 81, a fire button 82, a quick draw button 83, and a transmitter 84 for producing radio frequency (RF) signals 85 to communicate depressions of the fire button 82 and quick draw button 83, and movements of the mobility controls 81. Such RF signals 85 are received by the vehicle 70 and the action figure 20, as appropriate. In particular, movements of the mobility controls 81 are detected and transmitted by the hand-held remote control 80, and then received and decoded by the vehicle 70 to control a steering servo 72, and a throttle control 74 that selectively controls a drive motor 76 to make the vehicle move forwardly and rearwardly at varying speeds. In a similar manner, depressions of the fire button 82 and activation of the quick draw button 83 are communicated to the action figure 20.

The action figure 20 has a control unit 44, preferably microprocessor or microcontroller based, that provides the general functionality of the action figure 20 as previously described. In particular, the control unit 44 operates the solenoid 64 that selectively keeps the action figure body intact or detaches the same when a hit is registered, and facilitates reattachment once the reset button 40 is pressed. The control unit generates the light beam when prompted by the fire button 36, and receives incoming signals from the target detector 32. As previously described, the incoming signals representing the light beam received by the target detector 32 embody the action figure score of another action figure that generated said light beam. Of course, the action figure score is itself scored by the control unit 44, is visually tendered upon the score display 42, and is compared with scores encoded within incoming light beams in the manner described previously with reference to FIG. 8.

Also illustrated in FIG. 2 is the quick draw button 38 that is in direct communication with the control unit 44 and a quick draw button 83 on the hand-held remote control 80 in RF communication with the control unit 44. The gaming system has a quick draw mode, whereas the players can choose to enter a quick draw mode. When in the quick draw mode, essentially the action figure scores are temporarily ignored. Thus, when the action figures battle each other as illustrated in FIG. 8, the step of determining whether the encoded score within the incoming light beam is greater than the attacked (detecting) action figure's score 106 is eliminated. Instead, the action figure will determine a hit, and proceed to step 108 when an incoming light beam is detected—regardless of the score associated therewith. To allow the score to be disregarded, however, the player must voluntarily place the action figure in quick draw mode.

In conclusion, herein is presented a gaming system that integrates video game play with action figure play such that skillful video game play by a player provides that player a competitive advantage during action figure play. The invention is illustrated by example in the drawing figures, and throughout the written description. It should be understood that numerous variations are possible, while adhering to the inventive concept. Such variations are contemplated as being a part of the present invention.

What is claimed is:

1. A gaming system, using a video game system having video game controllers and a video display, and using an action figure associated with the player, comprising the steps of:

achieving a score by the player by playing the video game by viewing the video display while operating the video game controllers;

transferring the score from the video game system to the action figure; and interacting the action figure with other gaming system objects such that the effect of the action figure upon the other gaming system objects is determined by the score of the action figure.

2. The gaming system as recited in claim 1, wherein the action figure has a light producing gun and a target detector; and wherein the step of interacting the action figure with other gaming system objects further comprises firing the light producing gun to produce a light beam that is oriented at the other gaming system objects and determining a hit when the light beam hits the other gaming system object and the score of the action figure is greater than the value of said gaming system object.

3. The gaming system as recited in claim 2, wherein the gaming system objects include another action figure having a light producing gun and a target detector; wherein the value of said other action figure is its own score achieved through video game play; and wherein the step of determining a hit further comprises determining a hit by the action figure when the light beam of another action figure hits the target of the action figure and the score of the other action figure is greater than the score of the action figure.

4. The gaming system as recited in claim 3, further comprising a hand-held remote controller associated with each action figure; and wherein the step of firing the light producing gun for one of the action figures further comprises signaling said action figure to fire its light producing gun by the hand-held remote controller.

5. The gaming system as recited in claim 4, further comprising a vehicle associated with each action figure, said vehicle having steering and a motor for propelling the vehicle forwardly and rearwardly; and the method as recited further comprises the steps of seating the action figure upon the vehicle; and moving the action figure using the hand-held remote controller.

6. The gaming system as recited in claim 5, wherein each action figure has a quick draw mode; wherein the method as recited further comprises activating the quick draw mode on each of the action figures, firing the light producing gun of each action figure toward another of the action figures, and registering a hit by the action figure that first detects a light beam at its target detector.

7. The gaming system as recited in claim 6, wherein each action figure has an upper portion and a lower portion; the upper portion and lower portion are selectively attached to each other; and wherein the step of determining a hit by the action figure further comprises separating the upper and lower portion of the action figure.

8. The gaming system as recited in claim 3, wherein each action figure has an upper portion and a lower portion; the upper portion and lower portion are selectively attached to each other; and wherein the step of determining a hit by the action figure further comprises separating the upper and lower portion of the action figure.

9. The gaming system as recited in claim 8, further comprising a hand-held remote controller associated with each action figure; and wherein the step of firing the light producing gun for one of the action figures further comprises signaling said action figure to fire its light producing gun by the hand-held remote controller.

10. The gaming system as recited in claim 9, further comprising a vehicle associated with each action figure, said vehicle having steering and a motor for propelling the vehicle forwardly and rearwardly; and the method as recited further comprises the steps of seating the action figure upon the vehicle; and moving the action figure using the hand-held remote controller.

* * * * *